United States Patent [19]

Davies et al.

[11] Patent Number: 4,702,748

[45] **Date of Patent: * Oct. 27, 1987**

[54] PROCESS FOR STABILIZATION OF COAL LIQUID FRACTIONS

[75] Inventors: Geoffrey Davies, Boston, Mass.; Ahmed El-Toukhy, Alexandria, Egypt

[73] Assignee: Northeastern University, Boston, Mass.

[ * ] Notice: The portion of the term of this patent subsequent to Dec. 30, 2003 has been disclaimed.

[21] Appl. No.: 838,677

[22] Filed: Mar. 12, 1986

Related U.S. Application Data

[63] Continuation-in-part of Ser. No. 640,012, Aug. 10, 1984, Pat. No. 4,632,675.

[51] Int. Cl.[4] ..... C10L 1/18; C10L 1/32

[52] U.S. Cl. ..... 44/56; 44/53; 44/77

[58] Field of Search ..... 44/50, 51, 53, 56; 208/8 LE

[56] References Cited

U.S. PATENT DOCUMENTS

| | | | |
|---|---|---|---|
| 1,940,445 | 12/1933 | Calcott et al. | 44/72 |
| 1,992,014 | 2/1935 | Rogers et al. | 44/72 |
| 2,100,287 | 11/1937 | Conquest | 44/77 |
| 2,176,747 | 10/1938 | Schneider et al. | 44/77 |
| 2,219,859 | 10/1940 | White | 44/56 |
| 4,405,437 | 9/1983 | Kulik et al. | 208/8 LE |
| 4,420,930 | 12/1983 | Beuther et al. | 208/8 LE |
| 4,425,135 | 1/1984 | Jenkins | 208/8 LE |
| 4,428,818 | 1/1984 | Derbyshire et al. | 208/8 LE |

OTHER PUBLICATIONS

D. W. Brinkman et al., *Am. Chem. Society, D. V. Fuel Chem. Prepr.*, 25, 110 (1980).

Frankenfeld et al., *Am. Chem. Society, Div. Fuel Chem. Prepr.*, 23, 205 (1978).

Y. Y. Lin et al., *Am. Chem. Society., Div. Fuel Chem Prepr.*, 19, 2 (1974).

*Primary Examiner*—William R. Dixon, Jr.

*Assistant Examiner*—Ellen McAvoy

*Attorney, Agent, or Firm*—Weingarten, Schurgin, Gagnebin & Hayes

[57] ABSTRACT

Coal liquid fractions to be used as fuels are stabilized against gum formation and viscosity increases during storage, permitting the fuel to be burned as is, without further expensive treatments to remove gums or gum-forming materials. Stabilization is accomplished by addition of cyclohexanol or other simple inexpensive secondary and tertiary alcohols, secondary and tertiary amines, and ketones to such coal liquids at levels of 5–25% by weight with respect to the coal liquid being treated. Cyclohexanol is a particularly effective and cost-efficient stabilizer. Other stabilizers are isopropanol, diphenylmethanol, tertiary butanol, dipropylamine, triethylamine, diphenylamine, ethylmethylketone, cyclohexanone, methylphenylketone, and benzophenone. Experimental data indicate that stabilization is achieved by breaking hydrogen bonds between phenols in the coal liquid, thereby preventing or retarding oxidative coupling. In addition, it has been found that coal liquid fractions stabilized according to the invention can be mixed with petroleum-derived liquid fuels to produce mixtures in which gum deposition is prevented or reduced relative to similar mixtures not containing stabilizer.

8 Claims, 4 Drawing Figures

PROCESS FOR STABILIZATION OF COAL LIQUID FRACTIONS

This invention was made with Government support under Contract No. DE-FG22-83-PC60793 awarded by the Department of Energy. The Government has certain rights in this invention.

RELATED PATENT APPLICATIONS

This is a continuation-in-part of U.S. patent application Ser. No. 640,012, filed Aug. 10, 1984 by Geoffrey Davies, et al, now U.S. Pat. No. 4,632,675.

FIELD OF THE INVENTION

This invention concerns stabilization of coal liquid fractions, and more particularly, preventing or retarding asphaltene (gum) formation and viscosity increases upon storage by addition of simple inexpensive chemicals. In addition, the invention pertains to prevention or retardation of gum formation in mixtures of coal-derived liquids and petroleum-derived liquids by addition of such chemicals.

BACKGROUND OF THE INVENTION

Coad-derived liquid fuels have obvious advantages over other coal forms as energy sources. However, coal liquid fuels are known to deteriorate with time, the molecular weight, oxygen content, asphaltene (gum) content, and viscosity all increasing on processing and storage. See for example Frankenfeld, J. W. and Taylor, W. F., *Am. Chem. Soc., Div. Fuel Chem. Prepr.*, 23 (4), 205 (1978); Lin, Y. Y., Anderson, L. L. and Wiser, W. H., *Am. Chem. Soc., Div. Fuel Chem. Prepr.*, 19 (5), 2 (1974); Finseth, D., Hough, W., Queiser, J. A. and Retcofsky, H. L., *Am. Chem. Soc., Div. Petrol. Chem. Prepr.*, 24 (4), 979 (1979); Brown, F. R. and Karn, F. S., *Fuel*, 59, 431 (1980); Kershaw, J. R. and Gray, D., *Fuel*, 59, 436 (1980); Brinkman, D. W., Bowden, J. N., Frankenfeld, J. W. and Taylor, W. F., *Am. Chem. Soc., Div. Fuel Chem. Prepr.*, 25 (3), 110 (1980); Hara, T., Jones, L., Li, N. C. and Tewari, K. C., *Fuel*, 60, 1143 (1981).

Such deterioration adversely affects fuel handling, burner performance, and burning efficiency. Gum formation is a general phenomenon and presents serious practical problems. In the extreme case of solidification this could result in very serious problems and complete loss of the advantages of a liquid fuel.

Recent work by N. C. Li and coworkers strongly suggets that metal-catalyzed reactions of phenols with dioxygen are largely responsible for storage instability and deterioration of coal liquids. See, for example White, C. M. and Li, N. C., *Anal. Chem.*, 54, 1564 (1982); White, C. M. and Li, N. C., *Anal. Chem.*, 54, 1570 (1982); Jones, L. and Li, N. C., *Fuel*, 62, 1156 (1983); White, C. M., Jones, L. and Li, N. C., *Fuel* 62, 1397 (1983). The investigations of these workers have shown that phenolic constituents in coal liquid fractions are coupled in the presence of dioxygen to form various polymeric ethers, and have provided direct evidence for the presence of dimers, trimers, tetramers, and pentamers derived from phenols shown to be present initially.

In the past, attempts to stabilize coal liquid fractions have focused on cost-ineffective processes to remove phenolic materials, utilizing base extraction or conversion of phenolic materials to corresponding ether derivatives. Derivatization may be carried out in situ or after separation of the phenols from the coal liquid fraction, and in the latter case the ether derivatives have sometimes been returned to the coal liquid. These processes are shown in U.S. Pat. Nos. 4,277,326; 4,277,327; 4,299,691; 4,319,981; 4,353,792; 4,382,855; 4,406,780. It is possible to precipitate gums from aged coal liquid fractions by the addition of nonpolar hydrocarbons, as shown by Jones, L., and Li, N. C., *Fuel*, 62, 1156 (1983). Another possible approach to stabilization of coal liquid fractions is to upgrade such fractions by further hydrogenation under much more severe conditions than were used in the original liquifaction process, as shown by Young, L. J. S., Li, N. C., and Hardy, D., *Fuel*, 62, 1397 (1983). The objective then is to remove all potentially oxidizable functional groups from the fuel constituents while not creating new products which are even more highly reduced and still likely to be air sensitive. This approach has also been employed in U.S. Pat. No. 4,319,981.

All of the above-described processes for stabilizing coal liquid fractions constitute additional steps in the processing of such liquids, and require plant facilities, chemicals, and energy. As a result, they inevitably increase the cost of producing stable coal liquid fractions, to a point at which these processes become prohibitively expensive.

To avoid the expense of additional processing steps in the production of stable coal liquid fractions, it is most desirable to have a stabilizing process in which stabilization is achieved by adding one or more appropriate inexpensive stabilizing agents which retard or prevent viscosity increases and gum deposition. Such a process is the subject of this invention.

Coals and crude petroleum oils have different natural origins and contain quite different chemical constituents. Accordingly, liquid fuels derived from these different sources have different chemical and physical properties even though their boiling ranges may be similar. Liquid distillates obtained from coal liquefaction and the refining of oil both increase in viscosity and deposit gums upon storage in the presence of air. Although fuels from petroleum sources can be stabilized effectively against viscosity increases and gum formation by use of many antioxidant additives described in the prior art, such additives do not stabilize fuel fractions obtained from coal liquifaction because the processes responsible for fuel deterioration in the two cases are different.

As petroleum feedstocks decline, demand for coal-derived fuels is expected to increase. During the transition from petroleum to coal-based liquid fuels, it will be desirable to blend liquid fuels from coal and petroleum sources. Simply mixing such materials, however, will not work, since immediate gum deposition is observed upon mixing liquid fractions from petroleum sources with those from coal liquifaction. Accordingly, an inexpensive and efficient means for stabilizing such mixtures is desirable.

SUMMARY OF THE INVENTION

It has been found that coal liquid fractions are economically and simply stabilized with regard to viscosity increases and gum deposition on storage by the addition of cyclohexanol, which has the advantages of being quite inexpensive, high-boiling, and liquid. Stabilizing is achieved at levels of between 5 and 25% by weight relative to coal liquid. Certain other secondary and tertiary alcohols, secondary and tertiary amines, and ketones function similarly. In contrast to unstabilized coal liquid fuel fractions, which normally deposit gum and increase in viscosity under storage conditions, coal-derived fuels stabilized according to the invention do not deposit gums, and exhibit only slight or negligible increases in viscosity upon storage in sealed containers at temperatures of up to 50° C. The process has the important advantages of requiring no special equipment and being of very low cost. In addition, mixtures of coal liquid fractions and petroleum-derived liquids are also stabilized with respect to gum deposition by the inclusion of cyclohexanol at levels of between 5 and 25% by weight relative to coal-liquid employed.

BRIEF DESCRIPTION OF THE DRAWING

The invention will be more fully understood from the following detailed description taken in conjunction with the accompanying drawing, in which.

DETAILED DESCRIPTION OF THE INVENTION

Figure 1:
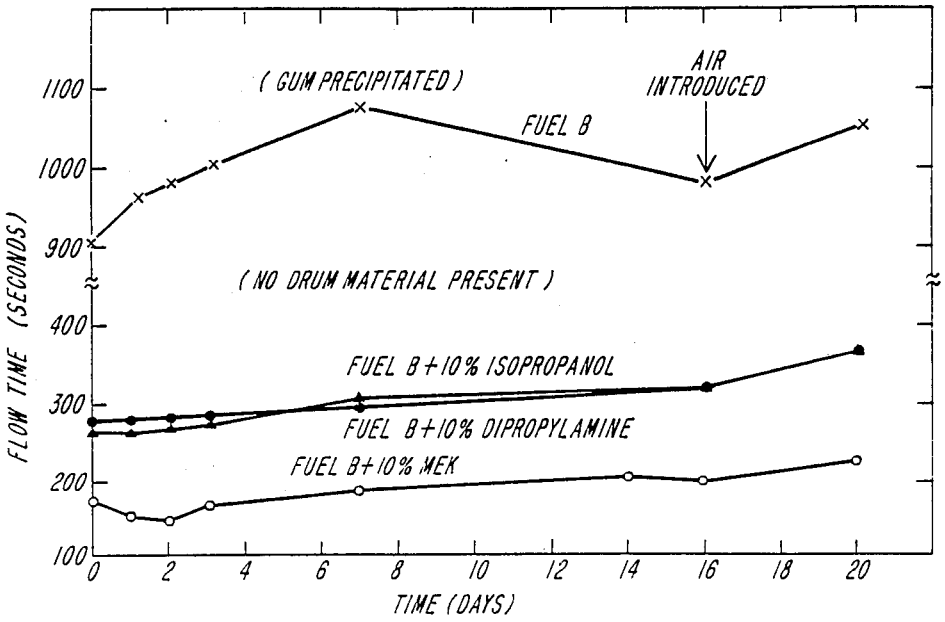
FIG. 1 is a plot of viscometer flow time vs. storage time, corresponding to the data of Table II.

Throughout this specification, the terms "coal liquid" and "coal liquid fraction" mean a liquid hydrocarbonaceous product derived from a process for liquifaction of coal. Further as employed herein, the term "petroleum-derived liquid fractions" means liquid hydrocarbonaceous fractions resulting from any process for refining of petroleum.

Secondary alcohols $R_1$—CH(OH)—$R_2$ where $R_1$ and $R_2$ are phenyl, substituted phenyl, or alkyl of from 1 to 4 carbon atoms, preferably methyl, or where $R_1$ and $R_2$ are linked and taken together with the carbon to which they are attached constitute a cycloalkyl group of from 3 to 9 carbons, preferably cyclohexyl, when added to coal liquid fractions at a level of between 5 and 25% w/w, preferably 10 to 15% w/w, are effective in stabilizing such coal fractions with respect to viscosity increases and gum deposition when the mixtures are stored in sealed containers at temperatures up to at least 50° C.

Tertiary alcohols

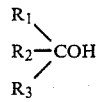

where $R_1$–$R_3$ are alkyl of from 1 to 4 carbon atoms, preferably methyl or where $R_1$ and $R_2$ are linked and taken together with the carbon to which they are attached constitute a cycloalkyl group of from 3 to 9 carbon atoms, preferably cyclohexyl, stabilize liquid coal fractions analogously to the above-described secondary alcohols.

Secondary amines $R_1$—NH—$R_2$ where $R_1$ and $R_2$ are phenyl, substituted phenyl, or alkyl of from 2 to 4 carbons, preferably propyl, or where $R_1$ and $R_2$ are linked and taken together with the nitrogen atom to which they are attached constitute a heterocycle containing from 4 to 6 carbon atoms, when added to coal liquid fractions at levels between 5 and 25% w/w, preferably between 10 and 15% w/w, are effective in stabilizing such coal fractions with respect to viscosity increases and gum deposition when the mixtures are stored in sealed containers at temperatures up to at least 50° C.

Tertiary amines

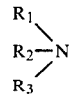

where $R_1$–$R_3$ are alkyl of from 1 to 4 carbon atoms, preferably ethyl, or where $R_1$ and $R_2$ are linked and taken together with the nitrogen atom to which they are attached constitute a heterocycle containing from 4 to 6 carbon atoms, stabilize coal liquid fractions analogously to the above-described secondary amines.

Ketones $R_1$—CO—$R_2$ where $R_1$ and $R_2$ are phenyl, substituted phenyl, or alkyl of from 1 to 3 carbon atoms, preferably methyl or ethyl, or where $R_1$ and $R_2$ are linked and taken together with the carbon to which they are attached constitute a cycloalkyl group of from 4 to 9 carbon atoms, for example cyclohexanone, when added to coal liquid fractions at levels between 5 and 25%, w/w, preferably between 10 and 15% w/w, are effective in stabilizing such fractions with respect to viscosity increases and gum deposition when the mixtures are stored in sealed containers at temperatures up to at least 50° C.

Mixtures of two or more of the above alcohols, amines, and ketones are also effective in stabilizing coal liquid fractions.

Additionally, secondary alcohols $R_1$—CH(OH)—$R_2$ where $R_1$ and $R_2$ are alkyl of 1 to 4 carbon atoms or where $R_1$ and $R_2$ are linked and taken tgoether with the carbon to which they are attached constitute a cycloalkyl group of from 3 to 9 carbons, preferably cyclohexyl, when included in mixtures of a coal liquid and a petroleum-derived liquid at a level of between 5 and 25% w/w with respect to coal liquid, preferably 5 to 20% w/w, and most preferably 10 to 15% w/w, are effective in stabilizing such mixtures against gum deposition.

Experimental Results Showing Stabilization of Coal Liquids Against Gum Formation and Viscosity Increases on Storage Aging experiments were carried out at 5° C.±2° C. in pyrex vessels, with pyrex gas delivery tubes (for flowing gas experiments) or tightly fitted stoppers (for headspace experiments). Drum material was cut from standard steel drums. Additives were used as received.

Viscosity measurements were made at 20° C.±0.05° C. using ASTM standard equipment with chloroform and nitrobenzene as standards.

1H NMR spectra were obtained with a JEOL Model FX60Q spectrometer at 25° C. with TMS as internal reference. Infrared spectra were recorded for samples as thin films on sodium chloride plates on a Perkin Elmer Model 567 spectrometer calibrated with the 906.5 or 3026.3 $cm^{-1}$ absorption of polystyrene.

Elemental analyses of coal liquids were made by MultiChem Laboratories, Lowell, Mass. Freezing point constants $K_f$ for nitrobenzene (7.0° C./molal) and cyclohexanol (30.7° C./molal) were determined with benzil as the standard. These freezing point constants were used for cryoscopic determination of the average moelcular weights of coal liquid fractions and gums precipitated from them.

Coal liquid fractions A, B, and C, derived from Illinois Number 6 coal, were obtained from Catalytic, Inc., Wilsonville, Ala. They were flushed with dinitrogen and stored at 0° C. in their shipping drums. The viscosities of fractions A and B were shown to be stable under these conditions over a 90-day period. Analytical and other data for these middle distillate fractions are given in Table I below.

TABLE I

Physical properties of Coal Liquid Fractions

| Fuel | A | B | C |
|---|---|---|---|
| Code # | 16814 | 16815 | 23156 |
| Boiling Range, °F. | 450-650 | 650-E.P.* | 650-E.P.* |
| Specific Gravity | 0.991 | 1.009 | 1.255 |
| Initial Viscosity (m poise) | 740 | 1960 | 7880 |
| % (w/w) Gum present | 3.0 | 4.5 | 6.0 |
| % C (liquid coal) | 88.0 | 88.2 | 88.6 |
| % C (Gum from liquid) | 80.1 | 82.2 | 82.3 |
| % H (liquid coal) | 10.1 | 9.8 | 9.5 |
| % H (Gum from liquid) | 7.4 | 7.6 | 7.0 |
| % N (liquid coal) | 0.28 | 0.45 | 0.50 |
| % N (Gum from liquid) | 1.95 | 2.00 | 2.17 |
| % S (liquid coal) | 0.23 | 0.73 | 1.28 |
| % S (Gum from liquid) | 1.02 | 0.89 | 0.96 |

*end point of the distillation

Preparation of Gum-free Coal Liquid Fractions

Pentane was added with stirring to a portion of coal liquid fraction B until its weight in the mixture reached 80% of the weight of coal liquid employed. The mixture was then stirred at room temperature overnight, during which time gum precipitated on the container walls. The supernatant liquid was decanted from the precipitate, and pentane was removed under vacuum on a rotary evaporator at room temperature, yielding low viscosity gum-free B($GFB_1$).

Upon distilling pentane at atmospheric pressure from the pentane-fuel supernatant solution, or heating $GFB_1$ in air at 50° C., a higher-viscosity gum-free material was produced, $GFB_2$. Material $GFB_2$ was found to have a specific gravity of 0.989, an initial viscosity of 959 mp, and elemental analyses of 88.6% C, 10.0% H, 0.24% N, and 0.10% S.

The precipitated gum was washed twice with pentane, and weighed by subtracting the weight of the container from the combined weight of the container and gum. Gum content was found to be consistent from preparation to preparation, averaging 4.5±0.1% for liquid coal B.

Gum-free A and gum-free C were similarly prepared from coal liquid fractions A and C by addition of pentane at levels of 85% and 75% by weight, respectively. Gum-free coal liquid fractions prepared in this way do not precipitate further gums during testing or storage, even in the presence of dioxygen. Material $GFA_2$ was found to have a specific gravity of 0.984 and elemental analyses of 88.0% C, 10.2% H, 0.33% N, and 0.18% S.

EXAMPLE I

Stabilization of Coal Liquid Fraction B by Additives

Separate aliquots of coal liquid fraction B were treated with isopropanol, dipropylamine, and ethylmethylketone, respectively, at a level of 10% by weight. The solutions were then stored in tightly-stoppered flasks at 50° C. and the viscosities of samples taken at various times were determined. An aliquot of coal liquid fraction B was similarly stored and tested, as a control. During the test the control precipitated gum, but the stabilized test mixtures did not. After sixteen days, the solutions were exposed to flowing ambient air to test gum prevention and viscosity stabilization under non-storage conditions. Results are shown in Table II, and FIG. 1. It is apparent that the presence of stabilizing additives reduces the viscosity of the coal liquid fraction, prevents substantial viscosity increases in the stored coal liquid fraction initially and over time, and prevents gum precipitation.

TABLE II

Flow Times (sec.) for Fuel B and Fuel B plus Additives Under Simulated Storage Conditions, and Under Non-Storage Conditions

| | Fuel B[a] | Fuel B + 10% isopropanol[b] | Fuel B + 10% MEK[c] | Fuel B + 10% dipropylamine[d] |
|---|---|---|---|---|
| initial | 906 | 260 | 170 | 275 |
| 1 day | 960 | 260 | 155 | 276 |
| 2 days | 980 | 265 | 145 | 280 |
| 3 days | 1005 | 275 | 163 | 285 |
| 7 days | 1070 | 315 | 180 | 300 |
| 14 days | — | — | 198 | — |
| 16 days* | 975 | 330 | 195 | 330 |
| 20 days | 1095 | 365 | 210 | 365 |

[a]gum precipitated
[b]boiling point = 82° C.
[c]methylethylketone; boiling point = 80° C.
[d]boiling point = 84° C.
*air flow started Several additional materials were evaluated according to the procedure of Example I except that flow times were measured only at the beginning and the end of the test period, and flowing air was not introduced. During the test the control precipitated gum, but the stabilized test mixtures did not. Results are shown in Table III.

TABLE III

Time-dependent Flow Times (t,sec) of Fuel B and Fuel B/10% Additive Mixtures

| Additive[a] | b.p. °C. | $t_o$[b] | $t_t$[c] |
|---|---|---|---|
| none | — | 460 | 511[d] |
| t-butanol | 83 | 177 | 255 |
| t-butanol, 5%/cyclohexanol, 5% | — | 198 | 202 |
| diphenylmethanol | 297 | 435 | 458 |
| triethylamine | 88 | 74 | 83 |
| diphenylamine | 302 | 303 | 339 |
| methylphenylketone | 202 | 180 | 210 |
| benzophenone | 305 | 367 | 446 |

[a]No gum deposition in the presence of additives
[b]time = 0
[c]time = 12 days
[d]Gum deposited

EXAMPLE II

Figure 2:
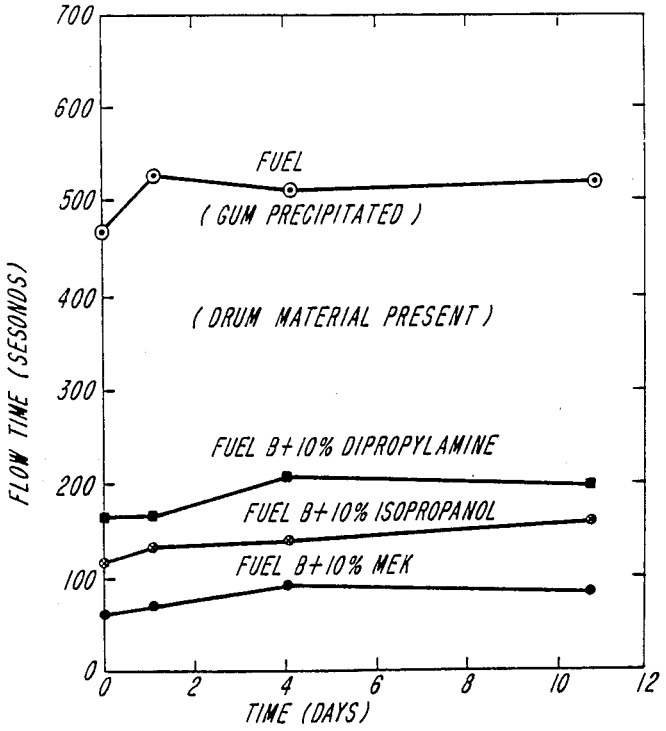
FIG. 2 is a plot of viscometer flow time vs. storage time, corresponding to the data of Table IV.

Stabilization of Coal Liquid Fraction B by Additives in the Presence of Drum Material The experiment of Example I was repeated with drum material (typically 1.2 g cut in narrow strips) present, for eleven days. No test with air was included. Untreated fuel B precipitated gum during the test, but stabilized test mixtures did not. Results are shown in Table IV, and FIG. 2. As found in the tests of Example I, the presence of stabilizing additives reduces the viscosity of the coal liquid fraction, prevents substantial viscosity increases in the stored coal liquid fraction initially and over time, and prevents gum precipitation.

TABLE IV

Flow Times (sec.) for Fuel B and Fuel B plus Additives Under Simulated Storage Conditions with Drum Material Present

| | Fuel B[a] | Fuel B + 10% isopropanol | Fuel B + 10% MEK[b] | Fuel B + 10% dipropylamine |
|---|---|---|---|---|
| initial | 480 | 110 | 62 | 159 |
| 1 day | 515 | 130 | 70 | 168 |
| 4 days | 500 | 140 | 80 | 200 |
| 11 days | 520 | 165 | 82 | 195 |

[a]gum precipitated
[b]methylethylketone

EXAMPLE III

Stabilization of Gum-free Coal Liquid B by Additives

Figure 3:
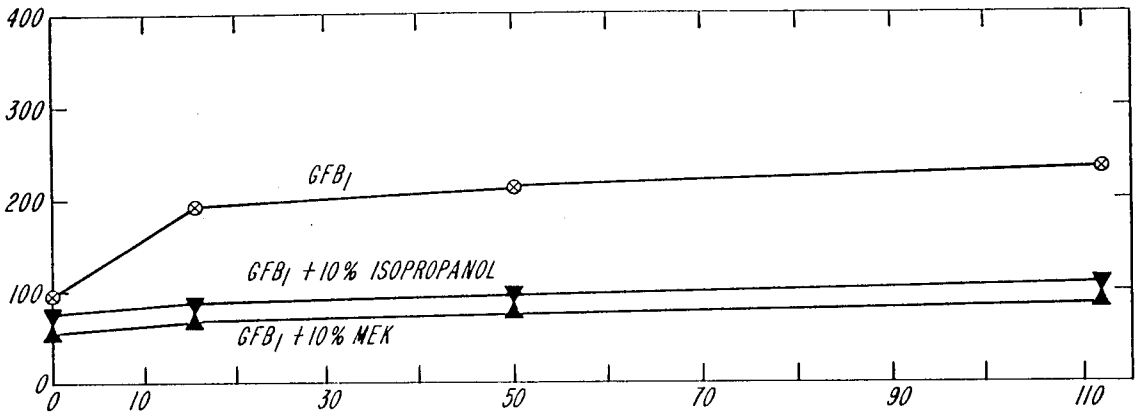
FIG. 3 is a plot of viscometer flow time vs. storage time, corresponding to the data of Table V.

Separate aliquots of gum-free coal liquid B ($GFB_1$) were treated with isopropanol, and ethylmethylketone, at a level of 10% by weight. The solutions were then stored in tightly stoppered flasks at 50° C. and the viscosities of samples taken at various times were determined. A aliquot of $GFB_1$ was similarly stored and tested, as a control. Results are shown in Table V, and FIG. 3. It is apparent that the presence of stabilizing additives prevents the rapid initial viscosity increase seen in the unstabilized fuel.

TABLE V

Flow Times (sec.) for $GFB_1$ and $GFB_1$ plus Additives Under Simulated Storage Conditons

| | $GFB_1$ | $GFB_1$ + 10% isopropanol | $GFB_1$ + 10% MEK[a] |
|---|---|---|---|
| 15 hr | 238 | 78 | 56 |
| 50 hr | 490 | 82 | 66 |
| 110 hr | 600 | 110 | 88 |

[a]methylethylketone

EXAMPLE IV

Stabilization of Coal Liquid Fraction A, B, and C by Cyclohexanol

Aliquots of Coal Liquid Fractions A, B, and C were treated with cyclohexanol (b.p. 160° C.) at levels of 10%, 10% and 15% by weight, respectively. The solutions were then stored in tightly-stoppered flasks at 50° C. and the viscosities were determined after three weeks. Results are shown in Table VI. It is apparent that cyclohexanol-stabilized coal liquid fractions show only small increases in viscosity upon storage, while the corresponding unstabilized materials showed relatively much larger viscosity increases, and also precipitated gums. Note that cyclohexanol stabilized effectively even in the presence of an added phenolic oxidative couping initiator.

TABLE VI

Time-dependent Viscosities of Fuel and Fuel/Cyclohexanol Mixtures

| Fuel | % w/w Cyclohexanol | Specific Gravity | $n_o^{a,b}$ m Poise | $n_t^{a,c}$ m Poise |
|---|---|---|---|---|
| A | 0 | 0.991 | 740(20) | 845(35)[d] |
| | 10 | 0.987 | 578(15) | 583(20) |
| | 10[e] | 0.985 | 560(20) | 580(15) |
| B | 0 | 1.009 | 1960(20) | 2325(40)[d] |
| | 10 | 0.994 | 1490(10) | 1550(25) |
| C | 0 | 1.255 | 7880(30) | 1049(40)[d] |

TABLE VI-continued

Time-dependent Viscosities of Fuel and Fuel/Cyclohexanol Mixtures

| Fuel | % w/w Cyclohexanol | Specific Gravity | $n_o^{a,b}$ m Poise | $n_t^{a,c}$ m Poise |
|---|---|---|---|---|
| | 15 | 1.000 | 2920(20) | 3100(20) |

[a]Viscosity measured at 20.00° C.; numbers in parentheses are 1 standard deviation.
[b]time = 0
[c]time = 21 days at 50° C. in presence of steel drum material.
[d]Gum deposition was observed in all experiments with no added cyclohexanol. No gum was deposited in any experiment with added cyclohexanol.
[e]Added phenolic oxidative coupling initiator: $[pyCuCl]_4O_2 = 1 \times 10^{-4}M$ (Davies, G. and El-Sayed, M.A., Inorg. Chem., 22, 1257 (1983).

Experimental Results Showing Stabilization of Mixtures of Coal Liquids and Petroleum-Derived Liquids Against Gum Deposition Mixing experiments shown below employed as petroleum-derived fuel liquids a standard No. 2 petroleum fuel oil sold for home heating use, and a standard No. 6 petroleum fuel oil sold for power plant use. Coal-derived liquids were obtained from Catalytic, Inc., of Wilsonville, Ala. and their physical properties are given above in Table 1. Coal liquids A and C exhibit long-term stabilization against gum formation and viscosity increase in the presence of 10% and 15% w/w cyclohexanol, respectively, when stored in air at 50° C. In the absence of this additive they deposit gum in a few hours and steadily increases in viscosity under the same conditions.

Mixtures of No. 2 fuel oil and coal liquid fraction A containing from 0 to 15% w/w cyclohexanol were prepared by mixing the materials in borosilicate glass vessels. The mixtures were stirred overnight in air, and any gum was then isolated, washed with pentane, dried in air, and weighed. Table VII below shows the amounts of gum deposited from such mixtures. Mixing fuel oil with unstabilized coal liquid at any level causes immediate gum precipitation in all cases. No gum deposition was observed in fuel oil-coal liquid blends containing 25% w/w of fuel oil and 75% w/w coal liquid containing 5% cyclohexanol, 55% w/w fuel oil and 45% w/w coal liquid containing 10% cyclohexanol, or 70% w/w of fuel oil and 30% w/w of coal liquid containing 15% cyclohexanol.

TABLE VII

Effect of Cyclohexanol on Deposition of Gums from Mixtures of No. 2 Fuel Oil and Coal Liquid Fracton A

| | % Gum Deposited with Coal Liquid Containing | | | |
|---|---|---|---|---|
| % Fuel Oil (w/w) | 0% $C_6H_{11}OH$ | 5% $C_6H_{11}OH$ | 10% $C_6H_{11}OH$ | 15% $C_6H_{11}OH$ |
| 5 | 0.10 | 0 | 0 | 0 |
| 10 | 0.20 | 0 | 0 | 0 |
| 20 | 0.44 | 0 | 0 | 0 |
| 25 | 0.56 | 0 | 0 | 0 |
| 30 | 0.69 | 0.14 | 0 | 0 |
| 40 | 0.93 | 0.34 | 0 | 0 |
| 50 | 1.28 | 0.61 | 0 | 0 |
| 55 | 1.39 | — | 0 | 0 |
| 60 | 1.50 | 0.82 | 0.02 | 0 |
| 70 | 1.62 | 0.96 | 0.07 | 0 |

Mixtures of No. 2 fuel oil and coal liquid C containing from 0 to 15% w/w cyclohexanol were similarly prepared and tested for gum deposition. Results are shown in Table VIII. It will be noted that cyclohexanol is more effective in preventing gum deposition in fuel oil-coal liquid C mixtures than in fuel oil-coal liquid A mixtures, up to 30% of fuel oil being blendable with coal liquid C containing but 5% cyclohexanol.

TABLE VIII

Effect of Cyclohexanol on Depositon of Gums from Mixtures of No. 2 Fuel Oil and Coal Liquid Fraction C

| % Fuel Oil (w/w) | % Gum deposited with Coal Liquid Containing 0% $C_6H_{11}OH$ | 5% $C_6H_{11}OH$ | 10% $C_6H_{11}OH$ | 15% $C_6H_{11}OH$ |
|---|---|---|---|---|
| 5 | 0.25 | 0 | 0 | 0 |
| 10 | 0.50 | 0 | 0 | 0 |
| 20 | 1.03 | 0 | 0 | 0 |
| 30 | 1.54 | 0 | 0 | 0 |
| 40 | 2.02 | 0.40 | 0 | 0 |
| 50 | 2.60 | 0.90 | 0 | 0 |
| 60 | 3.08 | 1.40 | 0 | 0 |
| 70 | 3.58 | 1.91 | 0.46 | 0 |
| 80 | 4.15 | 2.35 | 0.95 | 0 |

Mixtures of No. 6 fuel oil and coal liquid A containing from 0 to 15% w/w cyclohexanol were similarly prepared. Testing, however, was necessarily somewhat different from that employed with mixtures containing No. 2 fuel oil. No. 6 fuel oil possesses at room temperature globs of a segregated highly viscous fraction which flows only with difficulty. For this reason, it requires a preheater for handling. If No. 6 fuel oil is placed in a closed test tube at room temperature and the test tube is tipped, this highly viscous segregated material forms streamers on the tube wall as it oozes over the surface of the glass. Mixtures of No. 6 fuel oil and coal liquid fractions not containing cyclohexanol cyclohexanol behave similarly. However, if cyclohexanol is present in such mixtures the highly viscous fraction is no longer segregated into globs, but tends to separate from the bulk solution as a heavy liquid phase which forms a slowly moving film on the interior surface of a tipped test tube in the above-described qualitative test.

Accordingly, to test the effect of cyclohexanol upon mixtures of No. 6 fuel oil and coal liquids, No. 6 fuel oil was mixed in a tared erlenmeyer flask with coal liquid containing cyclohexanol, and the mixture was stirred for three hours, then allowed to settle. The flask was then tipped so that its side was approximately 45° relative to the bench, and allowed to drain at room temperature for three hours. Finally the flask with its high viscosity residue was re-weighed and the amount of residue was calculated. Results of such tests are presented in Table IX.

TABLE IX

Effect of Cyclohexanol on Mixture of No. 6 Fuel Oil and Coal Liquid Fraction A

| % Fuel Oil (w/w) | % Highly Viscous Remainder With Coal Liquid Containing 0% $C_6H_{11}OH$ | 5% $C_6H_{11}OH$ | 10% $C_6H_{11}OH$ | 15% $C_6H_{11}OH$ |
|---|---|---|---|---|
| 10 | 0.24 | — | — | — |
| 20 | 0.48 | — | — | — |
| 30 | 0.74 | — | — | 0.36 |
| 40 | 1.00 | 0.76 | 0.70 | 0.58 |
| 50 | 1.26 | 1.00 | 0.92 | 0.78 |
| 60 | 1.53 | 1.25 | 1.16 | 1.00 |
| 70 | 1.85 | 1.60 | 1.46 | 1.20 |
| 100 | 2.72 | — | — | — |

It is to be noted that although cyclohexanol did not eliminate highly viscous residues in mixtures of No. 6 fuel oil and coal liquids, it does reduce the amounts of such residues in the mixtures and it also makes such residues uniform and unsegregated rather than globular, thereby improving ease of handling of the mixtures substantially.

Figure 4:
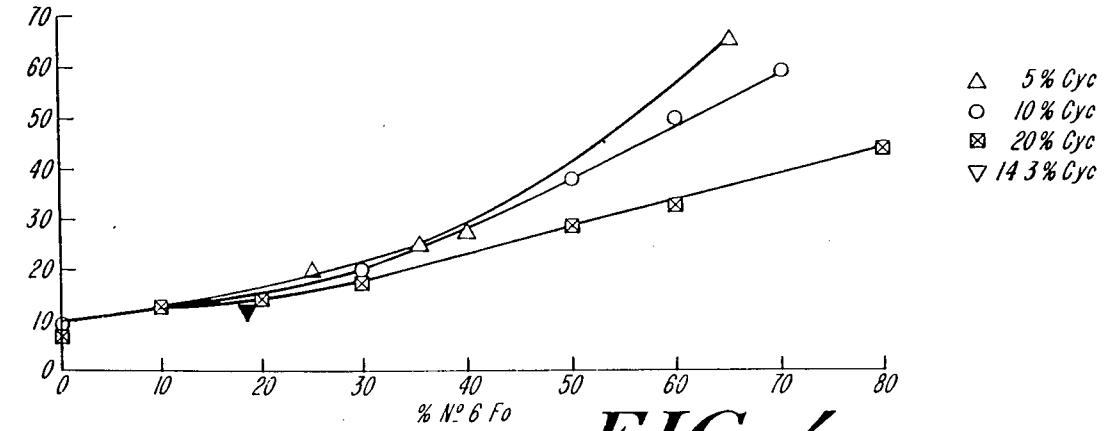
FIG. 4 is a plot of viscosities of mixtures of No. 6 fuel oil and coal liquid fraction A as a function of the amount of cyclohexanol present.

The benefits of the presence of cyclohexanol in mixtures of No. 6 fuel oil and coal liquid fraction A are further demonstrated by the smooth viscosity-composition profiles for such mixtures at 60°, shown in FIG. 4, which were highly reproducible. By contrast, very irreproducible results were obtained with no cyclohexanol present because of segregated deposit formation in mixtures of No. 6 fuel oil and coal liquid fraction A.

Mechanistic Considerations

While not wishing to be bound by theory, it is believed that the advantageous results obtained by using cyclohexanol to stabilize coal liquid fractions are obtained because cyclohexanol forms hydrogen bonds with phenols in the coal liquid fractions, thereby breaking hydrogen bond interactions between the phenols themselves, and retarding or preventing the phenols from undergoing oxidative polymerization. This hypothesis is based on the following experimental data:

a. The viscosity of samples of coal liquid fraction B containing progressively larger amounts of cyclohexanol decreased to a broad minimum at about 70% w/w cyclohexanol. No such minimum was observed for similar samples of fuel B in nitrobenzene, and the measured viscosity at 70% nitrobenzene was much lower, suggesting a specific interaction between some constituents of liquid coal fraction B and cyclohexanol.

b. When 25 parts of coal liquid fraction B and 70 parts of cyclohexanol were mixed with 5 parts of either phenol or pyridine, and the viscosities compared with the viscosity of a 25/70/5 fuel/cyclohexanol/cyclohexane mixture, it was found that the presence of phenol increased the flow time while pyridine decreased it, relative to the mixture with cyclohexane. It is concluded that cyclohexanol hydrogen bonds with phenols in the fuel.

c. Comparison of the infrared spectra of coal liquid fractions A, B, $GFA_2$, and $GFB_2$, and the corresponding pentane-precipitated gums showed that —OH(3400 $cm^{-1}$) and —C═N(1590 $cm^{-1}$) functions are concentrated in the gums. The infrared bands corresponding to the —OH and —C═N functions of the liquid fuels are shifted by $\pm(5-15)cm^{-1}$ on addition of 10% w/w cyclohexanol, again suggesting physical cyclohexanol-fuel interactions.

d. A comparison of the proton NMR spectra of cyclohexanol, coal liquid fraction B, and a mixture of coal liquid fraction B+10% w/w cyclohexanol showed that in the mixture, peaks corresponding to both fuel and cyclohexanol were shifted downfield and broadened relative to the same peaks in the spectra of fuel and cyclohexanol alone. This corresponds to proton deshielding expected for cyclohexanol-fuel interactions.

e. Molecular weights of gums (from A and B), $GFA_2$, $GFB_2$, A and B were measured cryoscopically in nitrobenzene ($K_f$ 7.0° C./molal) and in cyclohexanol ($K_f$ 30.7). In nitrobenzene, gum averaged 390–420 daltons, while the liquid fuel averages were in the range 300–345 daltons. The measured molecular wighjts of A and B were lower in cyclohexanol (average 190–220 daltons) than in nitrobenzene, again indicating that cyclohexanol disrupts specific interactions between fuel components.

It is believed that as all the additives of the invention are capable of hydrogen bonding, the explanation given above for the case of cyclohexanol applies to such other additives as well.

It is believed that in mixtures of coal liquids and petroleum derived liquids, cyclohexanol functions with respect to the coal liquid constituents in basically the same manner as it does in coal liquids alone, and further, that it serves as a solvent for constituents of petroleum derived fuels.

It is to be noted that higher boiling additives are preferred because they are less easily lost by evaporation than are more volatile additives. Also, the effectiveness of an additive is a function of its molecular weight, the molar ratio of additive to fuel constituents having a bearing on the extent of additive-fuel constituent interactions. Cyclohexanol is a particularly good additive in view of these considerations since it is both relatively low molecular weight and relatively high boiling, as well as inexpensive.

Although the invention has been exemplified with coal liquid fractions derived from Illinois Number 6 coal, coal liquids derived from other coals are similarly stabilized. The invention is not to be limited by what has been particularly shown and described, except as indicated by the appended claims.

What is claimed is:

1. A process for stabilizing a composition of coal liquid and petroleum-derived liquid fractions with respect to gum deposition, comprising:

preparing said composition to contain cyclohexanol at a level of from 5% to 20% by weight of the coal liquid employed, and storing the composition in a sealed container.

2. The process of claim 1 wherein cyclohexanol is employed in said composition at a level of from 10% to 15% by weight of the coal liquid.

3. A composition of coal liquid and petroleum-derived liquid fractions stabilized with respect to gum deposition, consisting essentially of a combination of the following materials:

a coal liquid fraction;

a petroleum-derived liquid fraction; and cyclohexanol, present in the composition at a level of from 5% to 20% by weight of the coal liquid fraction employed.

4. The composition of claim 3 wherein the amount of cyclohexanol is between 10% and 15% by weight of the coal liquid fraction.

5. A process for stabilizing a composition of coal liquid and petroleum-derived liquid fractions with respect to gum deposition, comprising:

preparing said composition to contain a secondary alcohol $R_1CH(OH)R_2$ where $R_1$ and $R_2$ are alkyl of from one to four carbon atoms or where $R_1$ and $R_2$ are linked and taken together with the carbon to which they are attached constitute a cycloalkyl group of from three to nine carbon atoms, said alcohol being employed at a level of from 5% to 20% by weight of the coal liquid employed, and storing said composition in a sealed container.

6. The process of claim 5 wherein said alcohol is employed in said composition at a level of from 10% to 15% by weight of the coal liquid.

7. A composition of coal liquid and petroleum-derived liquid fractions stabilized with respect to gum deposition, consisting essentially of a combination of the following materials:

a coal liquid fraction;

a petroleum-derived liquid fraction; and a secondary alcohol $R_1CH(OH)R_2$ where $R_1$ and $R_2$ are alkyl of from one to four carbon atoms or where $R_1$ and $R_2$ are linked and taken together with the carbon to which they are attached constitute a cycloalkyl group of from three to nine carbon atoms, said alcohol being present in the composition at a level of from 5% to 20% by weight of the coal liquid fraction employed.

8. The composition of claim 7 wherein the amount of said alcohol is between 10% and 15% by weight of the coal liquid fraction.

* * * * *

UNITED STATES PATENT AND TRADEMARK OFFICE

CERTIFICATE OF CORRECTION

PATENT NO. : 4,702,748 (Page 1 of 2)

DATED : October 27, 1987

INVENTOR(S) : Geoffrey Davies; Ahmed El-Toukhy

It is certified that error appears in the above-identified patent and that said Letters Patent is hereby corrected as shown below:

IN THE TITLE: "PROCESS FOR STABILIZATION OF COAL LIQUID FRACTIONS" should read

--PROCESS FOR STABILIZATION OF COAL LIQUID FRACTIONS, AND MIXTURES OF COAL LIQUID FRACTIONS AND PETROLEUM-DERIVED LIQUID FRACTIONS--

Column 1, lines 1-2, "PROCESS FOR STABILIZATION OF COAL LIQUID FRACTIONS" should read --PROCESS FOR STABILIZATION OF COAL LIQUID FRACTIONS, AND MIXTURES OF COAL LIQUID FRACTIONS AND PETROLEUM-DERIVED LIQUID FRACTIONS--

Column 2, lines 39-40, "liquefac- tion" should read --liquifac- tion-- line 65, "Stabilizing" should read --Stabilization--

Column 3, line 58, "methyl or" should read --methyl, or--

Column 4, line 38, "tgoether" should read --together-- line 50, "5° C. ± 2° C." should read --50° C. ± 2° C.-- line 63, "absorption" should read --absorptions--

Column 7, line 68, "1.255 7880(30) 1049(40)$^{d}$" should read --1.255 7880(30) 10490(40)$^{d}$--

UNITED STATES PATENT AND TRADEMARK OFFICE

CERTIFICATE OF CORRECTION

PATENT NO. : 4,702,748 (Page 2 of 2)

DATED : October 27, 1987

INVENTOR(S) : Geoffrey Davies; Ahmed El-Toukhy

It is certified that error appears in the above-identified patent and that said Letters Patent is hereby corrected as shown below:

Column 8, line 49, "Fracton A" should read --Fraction A--

Column 9, line 30, "cyclohexanol cyclohexanol" should read --cyclohexanol--

Column 9, line 50, "Mixture of No. 6" should read --Mixtures of No. 6--

Column 10, line 61, "molecular wighjts" should read --molecular weights--

Signed and Sealed this

Seventh Day of March, 1989

*Attest:*

*Attesting Officer*

DONALD J. QUIGG

*Commissioner of Patents and Trademarks*